United States Patent [19]

Lin

[11] Patent Number: 4,588,327

[45] Date of Patent: May 13, 1986

[54] PRECAST CONCRETE PILE AND METHOD OF PLACING IT IN THE GROUND

[76] Inventor: Juei J. Lin, 4th Fl., No. 37-39, Sec. 2, Shih Chuan Road, Panchiao City, Taiwan

[21] Appl. No.: 584,522

[22] Filed: Feb. 28, 1984

[51] Int. Cl.[4] ..... E02D 5/30; E02D 5/54

[52] U.S. Cl. ..... 405/244; 405/240; 405/256

[58] Field of Search ..... 405/231–233, 405/235, 236, 239, 240, 243, 248, 249, 251, 252, 255–257, 270

[56] References Cited

U.S. PATENT DOCUMENTS

| | | | |
|---|---|---|---|
| 1,856,604 | 5/1932 | Upson | 405/240 X |
| 2,008,521 | 7/1935 | Takechi | 405/233 |
| 2,952,130 | 9/1960 | Mueller | 405/240 |
| 3,152,450 | 10/1964 | Muller | 405/236 X |
| 3,512,365 | 5/1970 | Muller | 405/236 |
| 3,975,917 | 8/1976 | Asayama | 405/232 |

FOREIGN PATENT DOCUMENTS

| | | | |
|---|---|---|---|
| 108311 | 7/1982 | Japan | 405/240 |
| 146833 | 9/1982 | Japan | 405/244 |
| 10976 | of 1909 | United Kingdom | 405/256 |
| 397549 | 2/1933 | United Kingdom | 405/240 |

*Primary Examiner*—Cornelius J. Husar
*Assistant Examiner*—Nancy J. Stodola
*Attorney, Agent, or Firm*—Christie, Parker & Hale

[57] ABSTRACT

A precast concrete pile which includes a tapered end with alternating enlarged cross-sections and contracted cross-sections through its length. The concrete pile is driven into the ground together with a soil solidifying supply pipe and a cement slurry supply pipe. The pile footing in the ground is formed with concrete formations around the contracted sections, thereby increasing the bearing capacity of the pile footing.

3 Claims, 7 Drawing Figures

PRECAST CONCRETE PILE AND METHOD OF PLACING IT IN THE GROUND

BACKGROUND OF THE INVENTION

1. Field of the Invention

This invention relates to pile footings, particularly to a novel precast concrete pile and a method of placing a pile in the ground by which a foundation can be reinforced.

2. Related Art

It is known in the art that pile footings are driven into the ground to support and strengthen the superstructures. There is a type of reinforced concrete pile which is of uniform cross section with a tapered end and which can be driven into the ground directly by pile driving equipment. As the pile cross section is uniform, the friction between the pile and the surrounding earth is insufficient to prevent the sinking of the pile due to high load, earthquake, etc., unless the pile is driven until it reaches a hard bearing stratum. The sinking of the foundation easily happens in the loose earth, such as that area around coast-lines seashores, etc.

There is also another type of pile called a "cast-in-place" pile which includes a casing and an iron core. They are driven into the ground together, and, once in place, the core is pulled, and a concrete mixture is poured into the casing about 4 to 12 feet height. Then the iron core is again put into the casing, and subsequently the casing is pulled out about 2 to 4 feet. The concrete mixture is compressed by driving the core with a pile driver so that an enlarged base is formed. Thereafter, the iron core is completely pulled out, and the casing is filled with a concrete mixture. Finally the casing is pulled out. The formed pile has a uniform cross section structure and an enlarged base. However, such pile footing is still unsatisfactory for strengthening the foundation of the superstructure.

SUMMARY OF THE INVENTION

An object of the invention is to provide a reinforced concrete pile of improved construction which can offer considerable friction forces in relation to the surrounding earth, thereby increasing the bearing capacity and stability of the pile.

The foregoing and other objects can be achieved in accordance with the invention through the provision of a precast concrete pile which includes an elongated concrete structure with a tapered end provided at its lowest point and alternating enlarged cross sections and contracted cross sections throughout its length, each of said enlarged cross sections being provided with a longitudinal groove so as to receive a longitudinally extending pipe.

Alternatively, the precast concrete pile may comprise an elongated concrete structure which has a tapered end provided at its lower point and has alternating enlarged cross sections and contracted cross sections throughout its length, each of said enlarged portions being provided with a longitudinal groove, a pipe longitudinally received in said groove, and means for fastening said pipe to said concrete structure provided near the two ends of said structure.

In accordance with the invention, a method for placing a reinforced concrete pile footing may comprise: making a precast concrete pile which has an elongated concrete structure, a tapered end provided at its lowest side, with alternating enlarged cross sections and contracted cross sections throughout its length, each of said enlarged cross sections being provided with a longitudinal groove; fastening a longitudinal pipe to said precast concrete pile and causing it to be received in said groove; driving said pile into the ground; inserting soil solidifying agent through said pipe and gradually pulling out said pipe simultaneously. The method may further include the step of introducing a cement slurry through another pipe and gradually pulling out said pipe simultaneously.

The presently preferred exemplary embodiment will be described in detail with reference to the following drawings, wherein:

DETAILED DESCRIPTION OF THE PREFERRED EMBODIMENT

Figure 1:
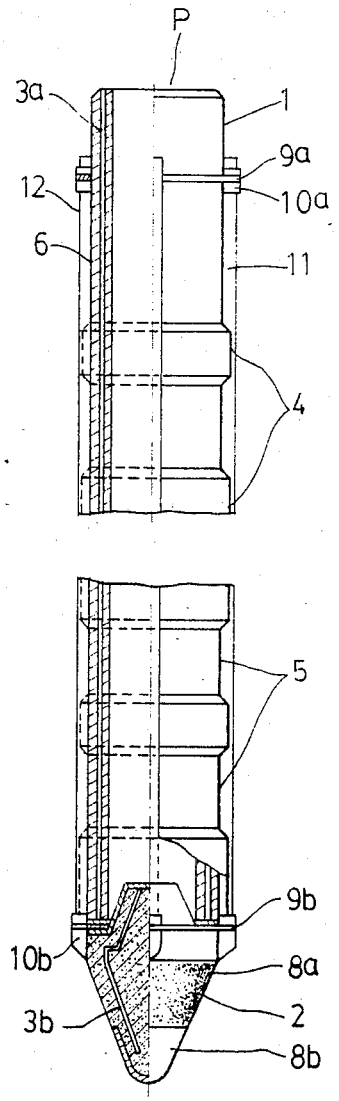
FIG. 1 is an elevation view of a precast concrete pile constructed according to the present invention.
Figure 2:
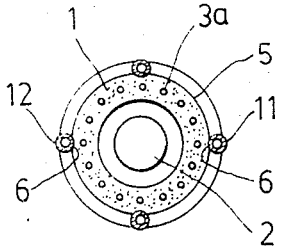
FIG. 2 is a transverse sectioned view of the same precast pile of FIG. 1.

Referring to FIGS. 1 and 2, there is shown a precast concrete pile p which is comprised of a cylindrical concrete structure 1 having a tapered end 2 and reinforced with steel wires 3*a* and 3*b*. The concrete structure 1 is provided with enlarged cross sections 4 which alternate with contracted sections 5 throughout the length of the pile p. Each of the enlarged cross sections 4 is provided with two pairs of diametrically opposite grooves 6 for receiving pipes 11 and 12. At the tapered end 2 is provided metal fence members 8*a* and 8*b*.

Near two ends of the structure 1 are provided fastening means 9*a* and 9*b* which have sleeve members 10*a* and 10*b*. The sleeves 10*a* and 10*b* respectively hold soil solidifying agent supply pipes 11 and cement slurry supply pipes 12 which are diametrically opposite and received in the grooves 6 of the enlarged cross section portions 4 so that these pipes 11 and 12 are closely adjacent to the contracted portions 5.

FIGS. 3 through 6 illustrate the construction operations of a pile footing by using the precast pile p. The pile p which is incorporated with pipes 11 and 12 is driven into the bed of soil A until reaching the desired depth in a usual way by means of a pile driver (see FIG. 3). A soil solidifying agent, such as water glass is introduced to the surrounding area of the pile p through the pipes 11 which are gradually pulled out. As the pipes 11 rise, the soil solidifying agent penetrates into and solidifies the surrounding soil (see FIG. 4).

Figure 7:
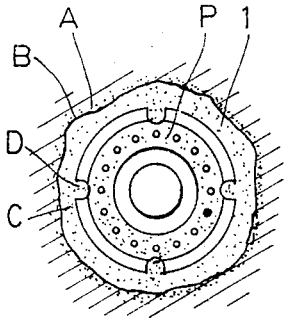
FIG. 7 shows a transverse sectioned view after the precast pile is in place in the ground.
Figures 3, 4, 5, 6:
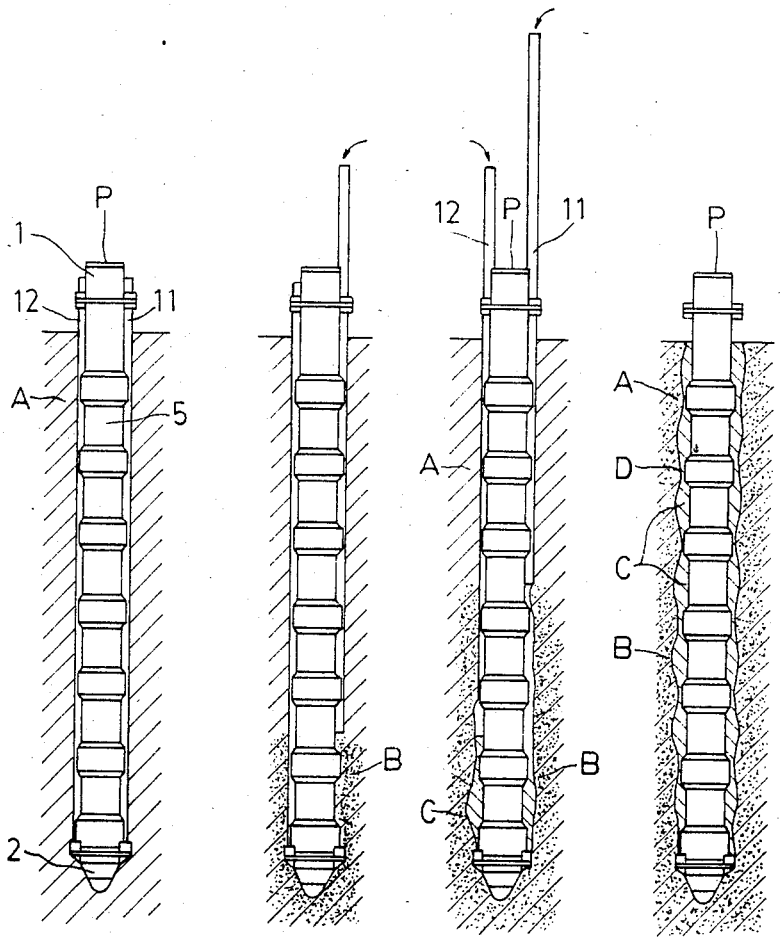
FIGS. 3 through 6 show the successive operations for driving the same precast pile.

After a period sufficient for the solidification of the soil, generally about 10 seconds or 1 to 2 minutes, the cement slurry is introduced into the pipe 12 by means of a cement slurry pump. At the same time, the pipes 12 are gradually pulled out. As the pipes 12 rise, the cement slurry penetrates into the surrounding solidified soil, and fill the spaces around the contracted portions 5 and grooves 6 left by the removal of pipes 12 (see FIG. 5). The surrounding soil B is impregnated with the concrete and is therefore reinforced. Additionally, this process also results in concrete formations C around the contracted portions 5 which are incorporated with the pile p and concrete formation D in the grooves 6 (see FIGS. 6 and 7).

The soil solidifying agent used in the invention is preferably water glass which has good penetrating characteristics and high-speed solidifying characteristics. After supplying the soil solidifying agent, the cement slurry can easily penetrate into and impregnate the soil.

There is also an advantage in that, when the pile p is driven into the ground, the compressed surrounding soil hollowed to the diameter of the enlarged portions 4 temporarily will not refill the spaces around the portion 5, and thus, as the soil solidifying agent and cement slurry are introduced on completion of the driving action, the pouring of the soil solidifying agent and cement slurry can be smoothly carried out.

According to the invention not only can the surrounding soil be reinforced, but also concrete formations C and D can be introduced which increase the bearing capacity of the pile and foundation stability. As the concrete formations C and D increase the friction between the pile p and the surrounding soil after the pile p is installed in the ground, sinking of the pile due to the high load of the superstructure or earthquake can be prevented. Due to the increased bearing capacity and stability of the pile footing, the amount of piles required can be reduced, thereby lowering the cost of constructing a pile foundation.

Further, when the pile p is driven, only enlarged portions 4 abut against the soil bed and therefore the frictional surface areas of the pile relative to the soil bed is less during the driving operation. Accordingly, this results in the reduction of the required driving power and an increase in the sinking rate of the pile during driving.

With the invention thus explained, it is apparent that obvious modifications and variations can be made without departing from the scope of the invention. It is therefore intended that the invention be limited only as indicated in the appended claims.

I claim:

1. A precast concrete pile comprising:

a cylindrical elongated concrete member comprising a conically tapered end and a plurality of enlarged spaced-apart circular cross sectional portions at intervals along the member which are one piece with the member, each of said enlarged circular cross sectional portions having a groove in a peripheral portion thereof, said groove in one said enlarged circular cross sectional portion being aligned with respective grooves in other said enlarged circular cross sectional portions;

a first longitudinal pipe received in said aligned grooves for delivering water or cement slurry; and means provided at upper and lower portions of said concrete member for fastening said pipe to said concrete member.

2. A precast concrete pile as claimed in claim 1, wherein said fastening means includes sleeve members for receiving the upper and lower portions of said longitudinal pipe.

3. A precast concrete pile as claimed in claim 1, further comprising a second longitudinal pipe for delivering a soil solidifying agent.

* * * * *